United States Patent [19]

Chung et al.

[11] Patent Number: 4,832,646

[45] Date of Patent: May 23, 1989

[54] AGING PROCESS FOR CATHODE RAY TUBES

[75] Inventors: Samuel S. Chung, Liverpool; Charles H. Rehkopf, Seneca Falls; Franklin G. Reigel, Waterloo, all of N.Y.; Doanld L. Siefker; James R. Stowe, both of Ottawa, Ohio

[73] Assignee: North American Philips Consumer Electronics Corp., New York, N.Y.

[21] Appl. No.: 145,637

[22] Filed: Jan. 11, 1988

Related U.S. Application Data

[63] Continuation of Ser. No. 876,150, Jun. 19, 1986, abandoned.

[51] Int. Cl.[4] ..... H01J 9/00

[52] U.S. Cl. ..... 445/6; 445/5

[58] Field of Search ..... 445/5, 6

[56] References Cited

U.S. PATENT DOCUMENTS

| | | | |
|---|---|---|---|
| 3,966,287 | 6/1976 | Liller | 445/5 |
| 4,395,242 | 7/1983 | Liller | 445/5 |
| 4,457,731 | 7/1984 | Patrickson | 445/5 |

FOREIGN PATENT DOCUMENTS

| | | | |
|---|---|---|---|
| 0049838 | 4/1980 | Japan | 445/6 |
| 0150247 | 9/1983 | Japan | 445/6 |

*Primary Examiner*—Kurt Rowan

*Attorney, Agent, or Firm*—John C. Fox

[57] ABSTRACT

An improved aging process for a cathode ray tube in which the main focusing grid (G3) is aged at a potential below that of the G2 grid, resulting in significantly reduced incidence of dark center cathode.

7 Claims, 6 Drawing Sheets

AGING PROCESS FOR CATHODE RAY TUBES

This is a continuation of application Ser. No. 876,150 filed June 19, 1986, now abandoned.

BACKGROUND OF THE INVENTION

This invention relates to the aging of cathode ray tubes, and more particularly relates to an improved aging process in which dark center cathodes caused by the aging of the focusing electrode are substantially reduced.

In the manufacture of cathode ray tubes for television and other display applications, various tube processing steps are carried out to insure an acceptable life of reliable operation in the field. This processing begins after assembly of the tube components, and includes: exhausting and baking the tube to evacuate the envelope and outgas the tube components; flashing a getter onto the internal surfaces of the tube and components to provide continuous gettering of residual contaminants which are outgassed during tube operation; activating the cathodes of the electron gun by heating to promote the formation of low work function species in the emission layer; aging the cathode and lower grid elements of the gun to maintain cathode activation; and finally high voltage conditioning of the electron gun to remove particles and projections which could lead to interelectrode arcing.

The rate of outgassing is time and temperature dependent, and the throughput demands of the manufacturing process as well as the limited thermal stability of certain tube components make complete outgassing during exhausting and baking impractical. Thus, some residual gas and gas-producing contaminants, such as hydrocarbons, remain in the tube after sealing of the exhaust tubulation.

Getter flashing usually introduces additional hydrocarbon contaminants into the tube. These hydrocarbons cannot be effectively adsorbed by the non-bakable barium getters commonly employed in many types of color television picture tubes. However, during subsequent aging, these hydrocarbons are dissociated into getterable components, resulting in the reduction of residual gas in the tube to acceptable levels.

Unfortunately, the aging process has also been found to result in a condition known as "dark center cathode", which by analysis has been found to be due to a carbon deposit in the center of the emissive layer of the cathode. Surprisingly, this deposit does not materially reduce cathode emission. However, it does restrict emission to the area of the perimeter of the emissive layer, resulting in a hollow beam which interferes with proper focusing and image resolution at the screen.

In U.S. Pat. No. 4,457,731, the dark center cathode problem is addressed for reprocessed cathode ray tubes. Tubes rejected for gun-related defects can be salvaged by "regunning", i.e,. replacing the defective gun with a new one. Since this regunning operation necessarily reopens the envelope to the ambient, the tube must be reprocessed. The patent teaches that dark center cathodes can be substantially reduced by flashing the getter after aging, so-called "post-flashing". However, when post-flashing is practiced on virgin tubes, unacceptably high gas levels result.

Accordingly, it is an object of this invention to provide an improved method for processing cathode ray tubes which reduces the incidence of dark center cathodes and does not result in unacceptably high gas levels.

It is another object of this invention to provide an improved aging process which may be carried out after sealing and getter flashing without producing dark center cathodes, and which will reduce residual gas to an acceptable level.

SUMMARY OF THE INVENTION

In accordance with the invention, it has been discovered that the successively higher voltages impressed on the G1, G2 and G3 grids during aging results in the focusing of the electrons emitted from the cathodes into an electron beam which dissociates residual hydrocarbons present in the tube after exhausting, baking and getter flashing, and that such dissociation results in the formation of a beam of positive carbon ions which travel in the reverse direction from the electron beam and are deposited on the cathode.

It has further been discovered that reducing the potential of the G3 grid during aging to a critical level above a threshold needed for effective aging of this grid, but sufficiently below the potential of the G2 grid to create a potential barrier to prevent the positive beam from reaching the cathode, significantly reduces the incidence of dark center cathodes while substantially retaining the benefits of G3 aging.

Accordingly, a process is provided for aging a cathode ray tube after the tube has been evacuated, sealed and getter flashed, and the cathode has been activated, the process comprising applying predetermined voltages to the cathode heaters and G1 grid of the tube's electron gun, to cause electron emission from the cathodes, and then sequentially adding predetermined voltages to the G2 and G3 grid electrodes of the gun, respectively, the G2 and G3 grid voltages being larger than the cathode and G1 grid voltages; characterized in that the G3 grid voltage is smaller than the G2 grid voltage.

In a preferred embodiment, the G3 grid electrode is at least 100 volts, and at least 50 volts less than the G2 grid electrode.

In another preferred embodiment, the G2 and G3 grids are connected to the same potential source, and the lower G3 grid potential is achieved by inserting a resistor between these two electrodes.

DESCRIPTION OF THE PREFERRED EMBODIMENTS

Figure 1:
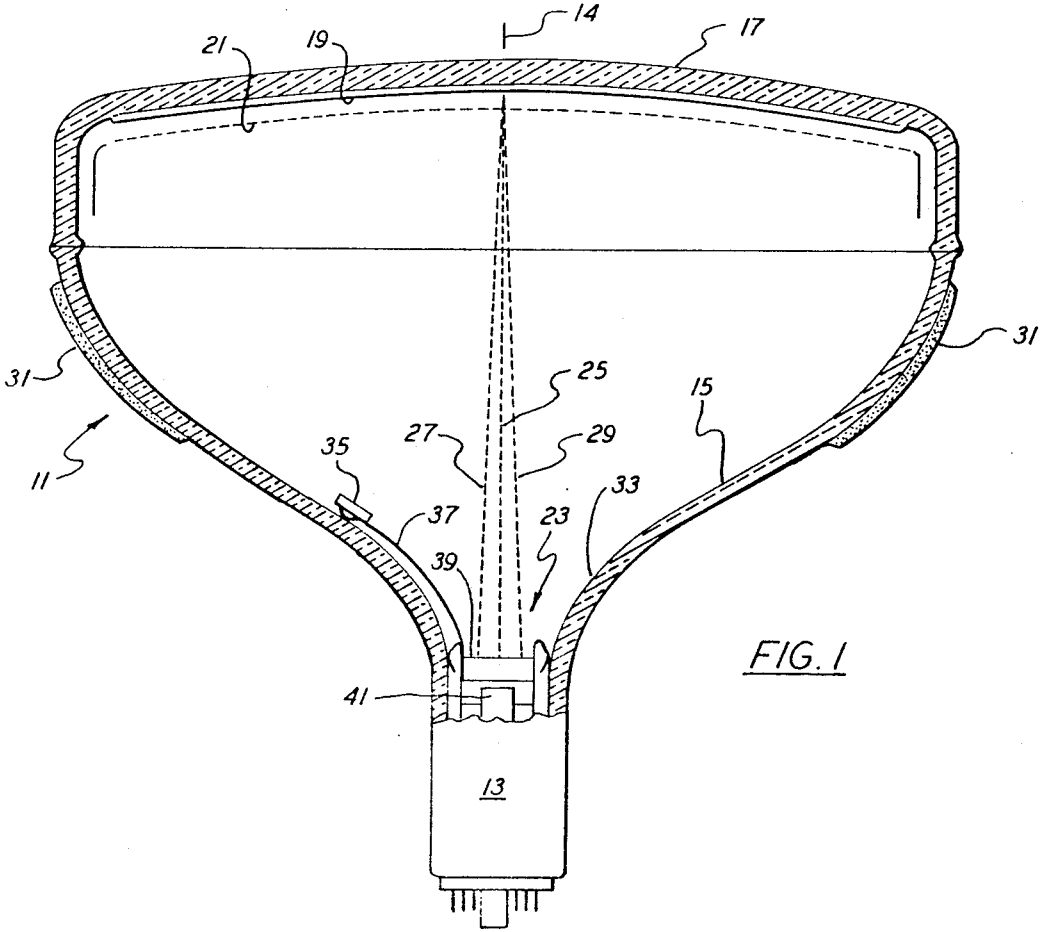
FIG. 1 is a partial cross-section view of a sealed and getter flashed cathode ray tube to be aged in accordance with the process of the invention.

With reference to the drawings, FIG. 1 is a sectioned view showing the essential elements of a plural beam in-line color cathode ray tube 11 employing the invention. Cathode ray tube 11 is oriented to have a central longitudinal axis 14 and X and Y axes normal to axis 14. The encompassing tube envelope is a glass structure comprised of a hermetically sealed integration of neck 13, funnel 15 and viewing panel 17 portions. Disposed on the interior surface of the viewing panel is a patterned cathodoluminescent screen 19 of stripes or dots of color-emitting phosphor materials. A multi-opening structure 21, in this instance an aperture mask, is positioned within the viewing panel in spaced relationship to the patterned screen 19. Encompassed within the neck portion 13 of the envelope is a unitized plural-beam in-line electron gun assembly 23, from which emanate three electron beams, a center beam 25 and two side beams 27 and 29 in a common in-line plane. These beams are directed and focused to traverse the aperture mask 21 and converge at screen 19 to excite the color-emitting phosphors.

The exterior surface of the tube has an electrically conductive coating 31, applied to the forward region of the funnel 15, and maintained at ground potential during tube usage.

The plural gun assembly 23 is positioned within the neck portion 13 in a manner whereby the three in-line beams 27, 25, and 29 are in a common horizontal "in-line" plane substantially coincident with the X axis of the tube. The gun assembly is a longitudinal construction of a plurality of spatially-related unitized in-line apertured electrode members. The electrodes are positioned in a spaced, sequential arrangement forward of individual electron emitting cathode elements to form, focus and accelerate each of the individual electron beams. The assembly is forwardly terminated by a convergence cup 39, and the whole structure is integrated by at least two oppositely disposed insulative multiform members, only one of which, 41, is shown. A getter container 35 is supported by wand 37 attached to convergence cup 39. A thin layer of getter material, not shown, was flashed from container 35 by induction heating, and covers portions of the inner surface of the envelope, mask and other tube components.

Figure 2:
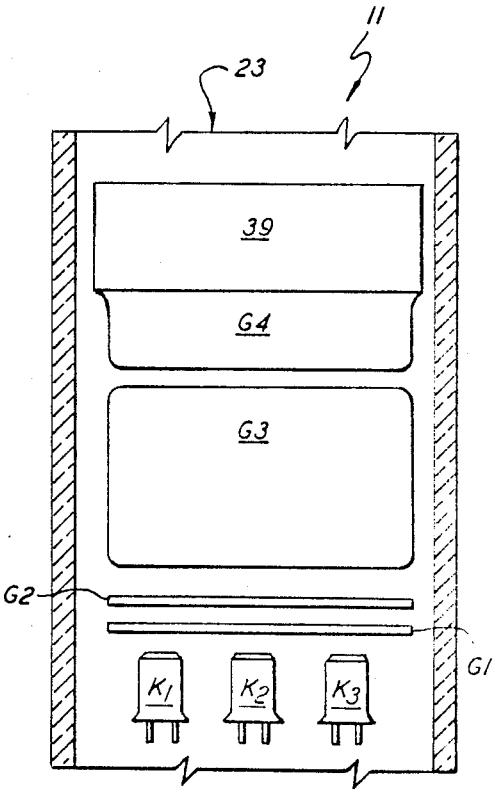
FIG. 2 is a partial cross-section of the neck portions of the cathode ray tube of FIG. 1, showing the cathode and grid elements of a bipotential electron gun to be aged in accordance with the process of the invention.

In FIG. 2, a unitized bi-potential electron gun assembly comprises a plurality of unitized in-line apertured electrode members sequentially positioned forward of individual cathode elements, $K_1$, $K_2$, $K_3$. The bipotential electrode arrangement includes an initial beam forming electrode (G1), and initial beam accelerating electrode (G2), a main focusing electrode (G3) having a longitudinal dimension defined by rearward and forward apertured ends and a final accelerating electrode (G4).

Figure 3:
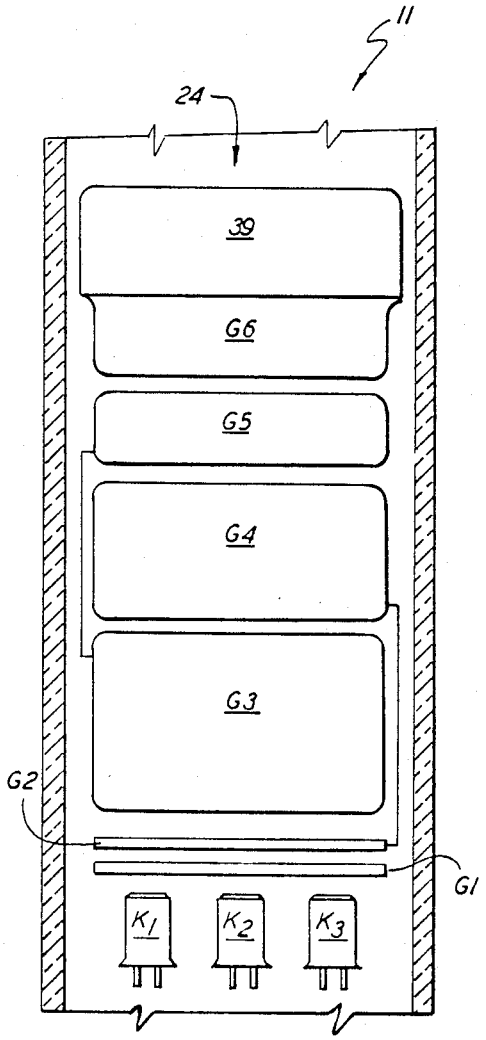
FIG. 3 is a view similar to that of FIG. 2, showing the elements of a quadripotential electron gun to be aged in accordance with the process of the invention.

In FIG. 3, a unitized quadri-potential in-line gun assembly has a plurality of electrodes positioned forward of individual cathode elements $K_1$, $K_2$, $K_3$, including an initial beam forming electrode (G1), an initial beam accelerating electrode (G2), a first high focusing electrode (G3), a low focusing electrode (G4) electrically connected to the (G2) electrode, a second high focusing electrode (G5) electrically connected to the (G3) electrode, and a final accelerating electrode (G6). Each of the (G3), (G4) and (G5) electrodes has a longitudinal dimension defined by forward and rearward apertured ends.

It is a standard practice in the manufacture of cathode ray tubes to subject the cathodes and lower grid elements of the electron gun to an aging treatment subsequent to exhausting, baking, sealing and getter flashing the tube. Such aging takes place immediately after the cathodes are activated, and prior to high voltage conditioning. Aging has at least two objectives in addition to preparing the emission layer itself, both of which are directed to maintaining cathode activation and thereby insuring adequate electron emission from the cathodes.

The first object of aging is to "condition" the surfaces of the adjacent grid elements, that is, heat the grids to remove particles, adsorbed gases and other residue which are potential sources of cathode contamination.

The second object of aging is to convert residual gases, mainly hydrocarbons, into getterable species. This is done by selecting the voltages on the cathode and various grid elements so as to result in an electron beam of sufficient energy to dissociate these residual gas molecules into smaller components.

Figure 4:
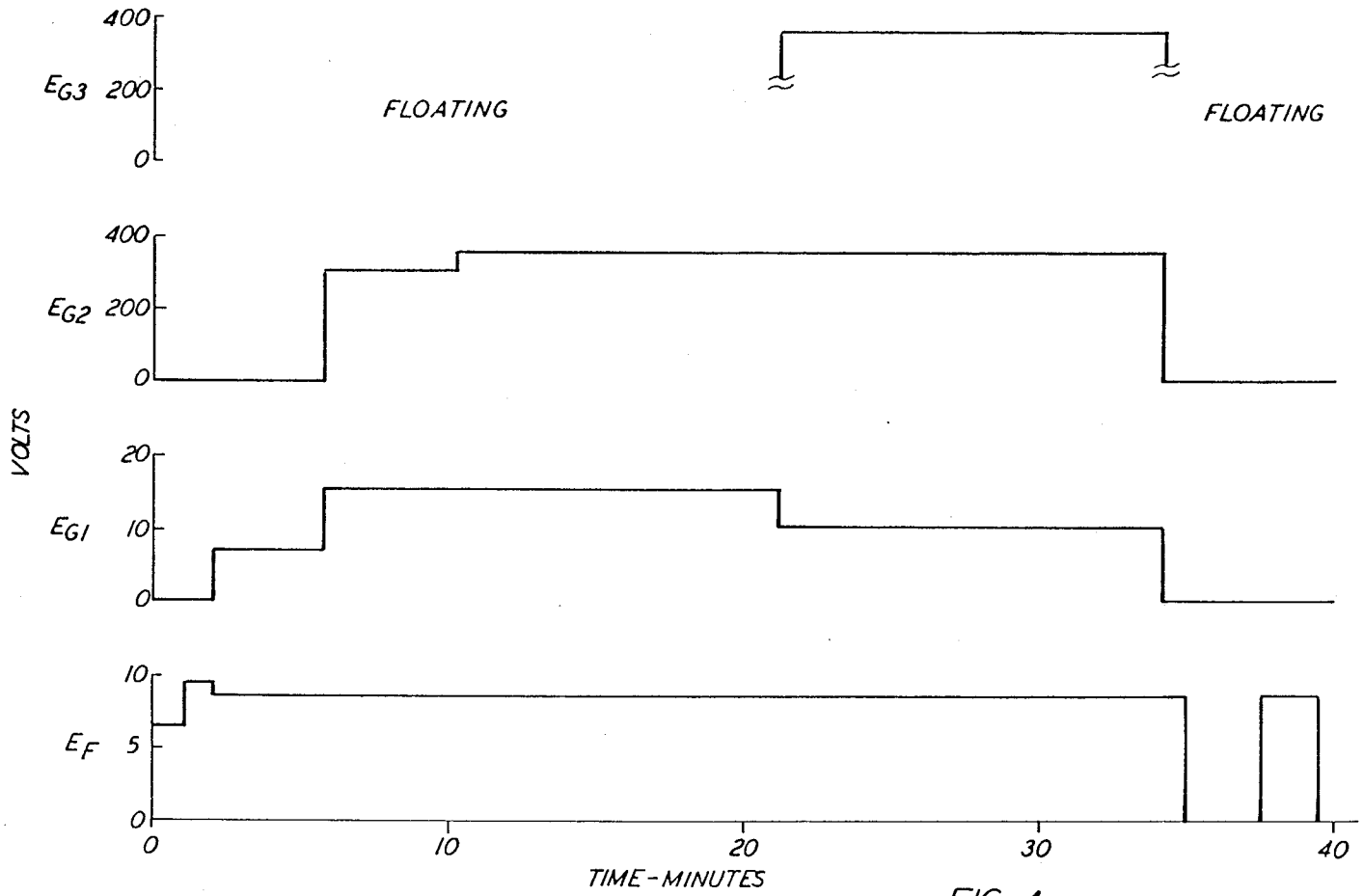
FIG. 4 Prior Art
FIG. 4 is a graph of time in minutes versus potential in volts for a typical cathode activating and tube aging schedule of the prior art.

A typical prior art schedule for activating the cathodes and aging the tube for a 19 V mini-neck color picture tube having a quadripotential focus electron gun is illustrated graphically in FIG. 4. Heater filament and G1, G2 and G3 grid potentials, expressed in volts and designated $E_F$, EG1, EG2 and EG3, respectively, are plotted versus time in minutes. As can be seen from the graph, the heater filaments are initially subjected to a relatively low potential ($E_F$) of about 6.5 volts for about 1 minute to preheat the cathodes and then the heater voltage is raised to about 9.5 volts for about 1 minute to activate the cathodes. Aging begins immediately after activation. A voltage of about 8.5 volts is maintained on the cathode heater filaments throughout the 33 minute aging cycle. At the start of aging, the G1 grid is subjected to a slightly lower potential of about 8 volts. After about 4 minutes, the G1 grid potential is increased to about 15 volts, and the G2 grid is subjected to a substantially higher potential of about 300 volts. After another 4.5 minutes the G2 potential is increased to 350 volts, and 11 minutes after that EG1 is reduced to 10 volts. At this time, about 19 minutes after the start of aging, the G3 grid is subjected to a potential of about 350 volts for about 13 minutes.

$E_F$ is maintained for about 1 minute after EG1, EG2 and EG3 have been turned off, and is subsequently reapplied for an additional two minutes to insure against the formation of detrimental deposits on the cathodes from the grids, and to further reduce any contaminants on the cathode surface.

Figure 7:
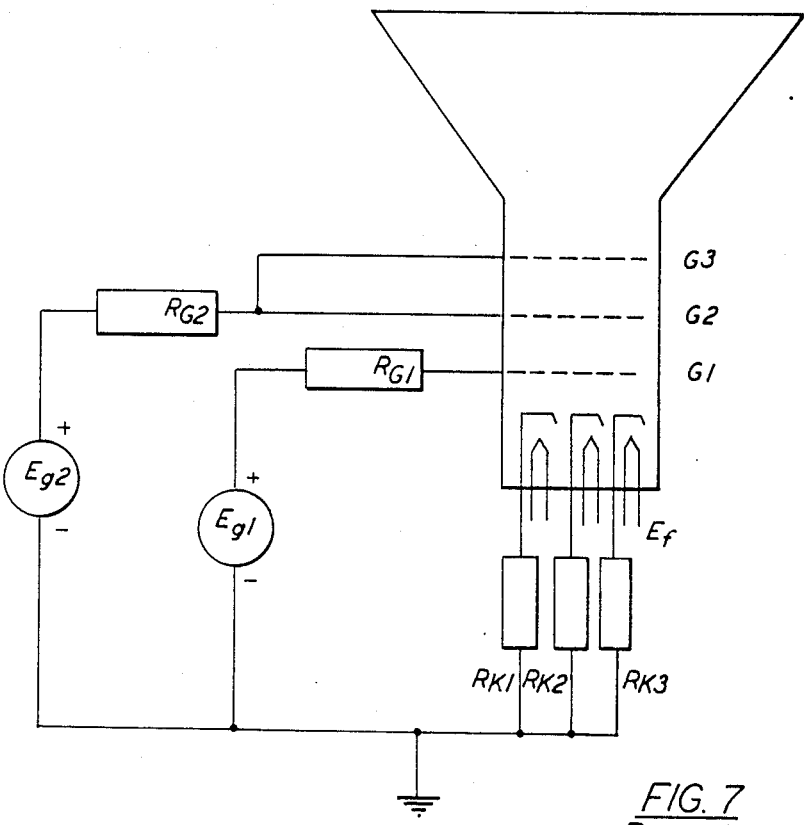
FIG. 7 Prior Art
FIG. 7 is a schematic diagram of a prior art arrangement for achieving the schedule of FIG. 4.

An arrangement for achieving the above activating and aging schedule is shown schematically in FIG. 7, wherein potential source $E_F$ supplies the cathode heater filaments, source EG1 supplies the grid, and source EG2 supplies both the G2 and G3 grids. The actual potential values for each gun element being aged are controlled by the values of the resistors. Typical values for resistors RK1–3, for example, are 150 ohms each, for RG1, 100 ohms, and for RG2, 5000 ohms. Since there is no resistor between G2 and G3, these grids are subjected to the same potential.

Figure 5:
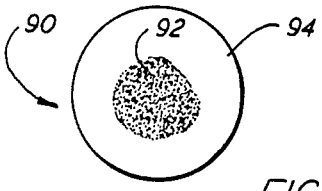
FIG. 5 is an enlarged plan view of a dark center cathode resulting from the prior art aging schedule of FIG. 4.

As has already been explained, when the G3 grid is subjected to a potential similar to that of G2, the positively charged carbon particles resulting from the dissociation of residual hydrocarbons are formed into a beam and directed back onto the cathodes, forming dark center cathodes similar to that illustrated in FIG. 5, wherein cathode 90 includes carbon deposit 92 in the center of emissive layer 94. In order to avoid such detrimental deposits, the potential of G3 must be lowered to create a barrier to the positively charged particle beam.

However, lowering the potential of G3 too far can have at least two adverse effects. First, it reduces the effectiveness of gas dissociation, by reducing the energy of electron beam. Second, it reduces the effectiveness of G3 conditioning, by reducing the temperature produced by energy dissipation in the grid. Both residual gas and contaminants on the G3 grid can find their way to the cathodes during later tube operation, reducing emission and consequently shortening tube life.

In order to avoid these disadvantages, it is necessary to maintain the G3 potential within a critical range during aging, high enough to provide effective gas dissociation and conditioning, but low enough to provide a barrier to the deposition of carbon on the cathodes. In this regard, it has been determined that the G3 potential should be at least 100 volts, and at least 50 volts below the G2 potential, and preferably at least 150 volts and at least 100 volts below the G2 potential.

Figure 6:
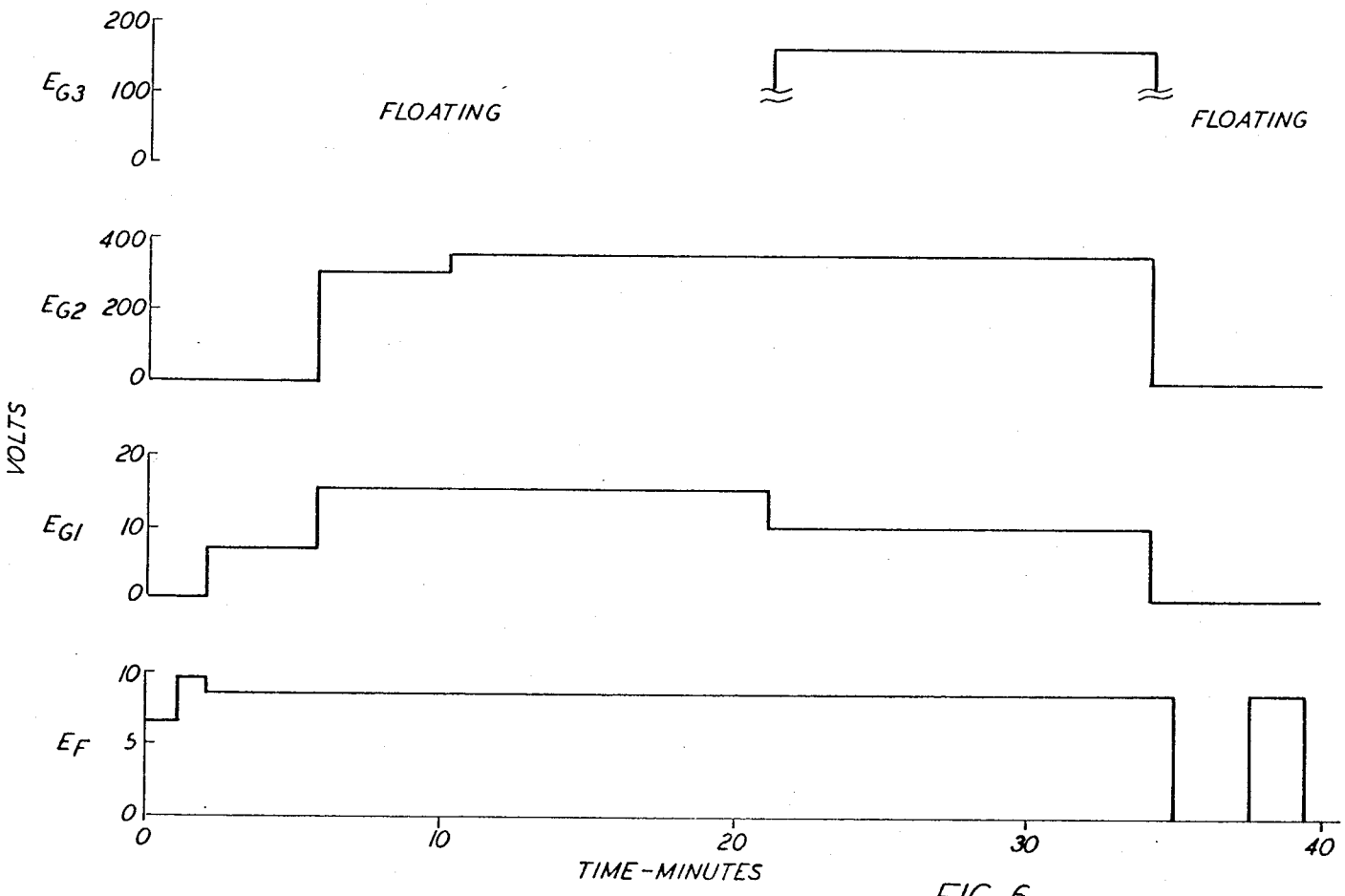
FIG. 6 is a graph of time in minutes versus potential in volts for a typical cathode activating and tube aging schedule of the invention.

In order to demonstrate the advantages of the invention, an illustrative example is presented. Three sets of samples of 26V CFF color picture tubes were divided into two groups. The first group was aged according to a prior art schedule similar to that described above for mini-neck tubes, and the second group was aged according to a schedule of the invention, depicted in FIG. 6. The samples were then compared for emission, dark center cathodes and emission slump.

Figure 8:
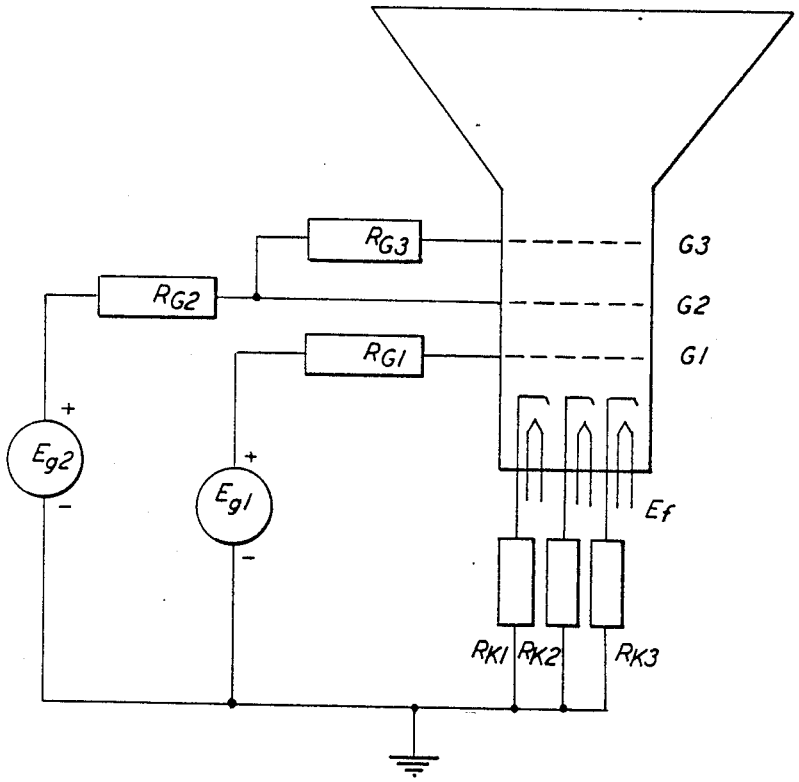
FIG. 8 is a schematic diagram of an arrangement of the invention for achieving the schedule of FIG. 6.

Arrangements similar to those shown in FIGS. 7 and 8 were used. In the prior art aging, (FIG. 7) the values of EG2 and RG2 were 600 volts and 5000 ohms, respectively, resulting in potentials of 515 volts at both the G2 and G3. The currents flowing to the G2 and G3 were 0.8 and 17 milliamps, respectively.

In the aging schedule of the invention, EG2 was reduced to 400 volts, and a 5000 ohm resistor (RG3 in FIG. 8) was inserted into the circuit between G2 and G3, resulting in potentials of 325 and 255 volts at G2 and G3, respectively. The currents flowing to the G2 and G3 were 0.5 and 15 milliamps, respectively.

Results are shown in the Table below.

TABLE

| | Cathode Emission Electron Volts | | | | | | | Emission Slump (Percent) | | |
|---|---|---|---|---|---|---|---|---|---|---|
| | Red Gun | | Green Gun | | Blue Gun | | Appearance of | | | |
| | $\overline{X}$ | s | $\overline{X}$ | s | $\overline{X}$ | s | Cathode Centers | Red | Green | Blue |
| Set #1 | | | | | | | | | | |
| Group 1 | 3438 | 44 | 3482 | 29 | 3498 | 39 | 20 light deposits out of 30 | — | — | — |
| Group II | 3468 | 40 | 3453 | 36 | 3485 | 43 | 1 light deposit out of 36 | — | — | — |
| Set #2 | | | | | | | | | | |
| Group 1 | 3391 | — | 3484 | 40 | 3490 | 35 | 7 light deposits out of 30 | 8 | 6 | 9 |
| Group II | 3436 | 40 | 3483 | 21 | 3471 | 34 | 0 out of 33 | 3 | 0 | 7 |
| Set #3 | | | | | | | | | | |
| Group 1 | 3433 | 77 | 3443 | 73 | 3412 | 92 | 6 heavy deposits, 2 moderate deposits, 12 light deposits out of 33 | 4 | 8 | 8 |
| Group II | 3461 | 32 | 3462 | 28 | 3452 | 31 | 2 light deposits out of 33 | 4 | 2 | 2 |

Emission and emission slump are reported for each of the red, green and blue guns. Emission is reported in microamperes as an average ($\overline{X}$) of 10 to 12 samples, with standard deviations (s). Emission slump is reported as percent decrease in emission after 5 seconds at a filament potential of 5 volts and zero bias. Appearance of the cathodes after aging was visually rated as zero, moderate and heavy deposits, and reported without distinction between individual guns.

As can be seen from the results, the aging schedule of the invention Group II) resulted in good emission levels, significantly better stability s indicated by lower slump, and substantially reduced incidence of dark enter cathodes.

We claim:

1. A process for aging a cathode ray tube after the tube has been evacuated, sealed and getter flashed, and the cathode has been activated; the process comprising applying predetermined voltages to the cathode heaters and G1 grid of the tube's electron gun, so as to result in the emission of electrons from the cathodes, and then sequentially adding predetermined voltages to the G2 and G3 grid electrodes of the gun, respectively, the G2 and G3 grid voltages being larger than the cathode and G1 grid voltages;

characterized in that the G3 grid voltage is: (a) substantially invarant; (b) smaller than the G2 grid voltage; and (c) at least about 100 volts.

2. The aging process of claim 1 in which the G3 grid voltage is at least 50 volts less than the G2 grid voltage.

3. The aging process of claim 1 in which the G3 grid electrodes is at least 150 volts.

4. The aging process of claim 2 in which the G3 grid voltage is at least 100 volts less than the G2 grid voltage.

5. The aging process of claim 1 in which the heater voltage is within the range of from about 5 to 10 volts.

6. The aging process of claim 1 in which the G1 grid voltage is within the range of from about 5 to 20 volts.

7. The aging process of claim 1 in which the G2 grid voltage is within the range of from about 250 to 400 volts.

* * * * *